US008512059B2

(12) United States Patent
Schaefer et al.

(10) Patent No.: US 8,512,059 B2
(45) Date of Patent: Aug. 20, 2013

(54) X-RAY SHIELDED CONNECTOR

(75) Inventors: Thomas Dean Schaefer, Milwaukee, WI (US); Ron Kent Hockersmith, Milwaukee, WI (US); Edward Emaci, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 101 days.

(21) Appl. No.: 12/987,889

(22) Filed: Jan. 10, 2011

(65) Prior Publication Data

US 2012/0178297 A1 Jul. 12, 2012

(51) Int. Cl.
*H01R 13/52* (2006.01)

(52) U.S. Cl.
USPC ..... 439/271

(58) Field of Classification Search
USPC ..... 439/271, 274, 279, 282, 625; 378/121, 378/140, 203, 204, 194; 174/652, 76, 151, 174/84 R; 310/171
See application file for complete search history.

(56) References Cited

U.S. PATENT DOCUMENTS

| | | | | |
|---|---|---|---|---|
| 3,555,487 | A * | 1/1971 | Jones | 439/282 |
| 4,626,721 | A * | 12/1986 | Ouchi | 310/71 |
| 6,494,618 | B1 * | 12/2002 | Moulton | 378/204 |
| 6,641,421 | B1 * | 11/2003 | Leavitt et al. | 439/271 |
| 6,676,447 | B1 * | 1/2004 | Knox | 439/587 |
| 7,071,588 | B1 * | 7/2006 | Khazanov | 310/71 |
| 7,142,639 | B2 * | 11/2006 | Smith et al. | 378/121 |
| 2005/0232395 | A1 * | 10/2005 | Smith et al. | 378/121 |
| 2012/0106713 | A1 * | 5/2012 | Parker et al. | 378/140 |

* cited by examiner

*Primary Examiner* — Alwxander Gilman
(74) *Attorney, Agent, or Firm* — Fletcher Yoder, P.C.

(57) ABSTRACT

The present embodiments relate to off-focal X-ray radiation attenuation within a connector. In one embodiment, a connector X-ray shielding capabilities is provided. The connector includes a housing with openings for an electrical cable as well as an electrical connection. The connector further includes an X-ray shielding liner made of moldable synthetic material doped with an X-ray attenuating material. The X-ray shielding liner is disposed within the housing, and also includes openings for the electrical cable and electrical connection.

6 Claims, 2 Drawing Sheets

X-RAY SHIELDED CONNECTOR

BACKGROUND OF THE INVENTION

The subject matter disclosed herein relates to housings and/or internal materials of connectors for X-ray systems, and in particular, to X-ray shielding mechanisms within a connector.

A number of radiological imaging systems of various designs are known and are presently in use. Such systems are designed for the purpose of generation of X-rays that are directed toward, and expose, a subject of interest to ionizing radiation. The X-rays traverse to and through the subject and impact X-ray sensitive film or a digital detector. In medical diagnostic contexts, for example, such systems may be used to visualize internal anatomy and identify patient ailments. In other X-ray utilization applications, various assembled equipment, manufactured parts, baggage, parcels, and other objects may be imaged to assess their contents, for safety, integrity, and other purposes. In general, X-ray systems of the type referred to by the present disclosure may include projection X-ray systems, fluoroscopic systems, X-ray tomosynthesis systems, computed tomography systems, and various mixed or combined-modality systems that utilize X-ray imaging in conjunction with other imaging physics, such as ultrasound, positron emission tomography, magnetic resonance imaging, and so forth. Other unintended X-ray generating systems include but are not limited to conventional vacuum tubes, used in old televisions.

In general, an X-ray tube is comprised of a cathode and an anode. The cathode generally has a thermionic filament used to generate electrons. The anode generally has a target region disposed to the cathode and filament. Electricity is typically supplied to the cathode, or the anode, or both, via a high voltage connector(s), connecting the X-ray system to an electrical source(s). Electrical voltage is applied to the cathode and/or the anode with a potential difference, creating an electrical field. Electrical current is also applied to the cathode filament resulting in filament heating. When the work function of the filament material is exceeded, thermionic emission occurs from the filament within the cathode and it emits electrons. Due to the cathode/anode voltage potential difference, these electrons are accelerated from the cathode toward the anode target, with the electrons eventually impacting the target. Once the target is bombarded with the stream of electrons, it produces X-ray radiation.

Despite the electron stream colliding with the anode target in the proper location, some X-rays do not exit through the desired aperture toward the subject of interest, but instead are back scattered throughout the X-ray tube. This off-focal X-ray radiation generated in the X-ray tube must be contained so that X-ray system operators and subjects are not exposed to excessive radiation and there is no interference with the X-ray imaging system. One area where these X-rays may be contained includes the high voltage power connector. Traditionally, these connectors include separate X-ray shielding means contained within connector housings or external to the connector housings. These housings are typically made with high density materials like tungsten or lead and captured within complex assemblies for cost or safety reasons. While these shielding assemblies help to reduce exposure to off-focal X-ray radiation, separate X-ray shielding assemblies often may require costly and complex manufacturing processes. Further, these shielding assemblies may be less effective in shielding X-rays, due to limitations in design based upon said manufacturing complexity. Accordingly, a need exists for a lower-cost, simpler manufacturing method for more effective X-ray shielding mechanisms within housings, for example a high-voltage connector housing.

BRIEF DESCRIPTION OF THE INVENTION

In one embodiment, a connector is provided that includes a housing having a cable opening for an electrical cable and a connector opening for an electrical connection. In addition, the connector has an X-ray shielding liner disposed in the housing with openings for passage of the electrical cable and for the electrical connection. The liner is formed from a moldable synthetic material doped with an X-ray attenuating material.

In another embodiment, A connector is provided that includes a housing having a cable opening for an electrical cable and a connector opening for an electrical connection, an electrical cable extending through the cable opening, and a cup disposed in the housing. The electrical cable extends into the cup, and at least one conductor is electrically coupled to the electrical cable in the cup. Additionally, an X-ray shielding liner, comprising a moldable synthetic material doped with an X-ray attenuating material, is disposed in the housing. The shielding liner has openings for passage of the electrical cable and for the electrical connection. The connector further has a first potting material disposed in the cup and a second potting material disposed between the cup and the liner.

In a further embodiment, a method of making a connector is provided including disposing an X-ray shielding liner in a housing, the liner comprising a moldable synthetic material doped with an X-ray attenuating material, making an electrical connection between an electrical cable and at least one conductor in a volume at least partially surrounded by the liner, and potting the volume.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

X-ray system connectors utilizing separate X-ray shielding assemblies may require complex manufacturing processes, leading to increased cost and production time. For instance, separate X-ray shielding assemblies may require the production of additional parts and may require brazing or welding processes to complete a connector assembly. Additionally, the assembly processes for these X-ray shields may require seams, which may potentially allow X-ray leakage through the shielding. High X-ray attenuation materials may also be toxic or have significant cost constraints. Accordingly, it is now recognized that it may be desirable for an X-ray shielded connector to include shielding materials within the connector housing. Indeed, in such configurations, manufacturing processes may be simplified, reducing production costs and manufacturing time. Additionally, such configurations may reduce X-ray leakage by removing seams caused during assembly of a separate X-ray shield.

In the present context, incorporating X-ray shielding within a connector housing may include gluing or pouring X-ray shielding materials into the connector housing. Unlike other possible approaches which may require manufacturing a separate X-ray shield assembly through a process requiring seams in the shield as well as brazing and/or welding, the present embodiments allow for a reduction in manufacturing complexity by simplifying the formation of the X-ray shield through disposing X-ray attenuation materials into the connector housing. Technical advantages of the disclosed embodiments may therefore include a reduction in manufacturing complexity and cost, as well as decreased X-ray leakage due to a reduction of seams in the X-ray shielding.

Figure 1:
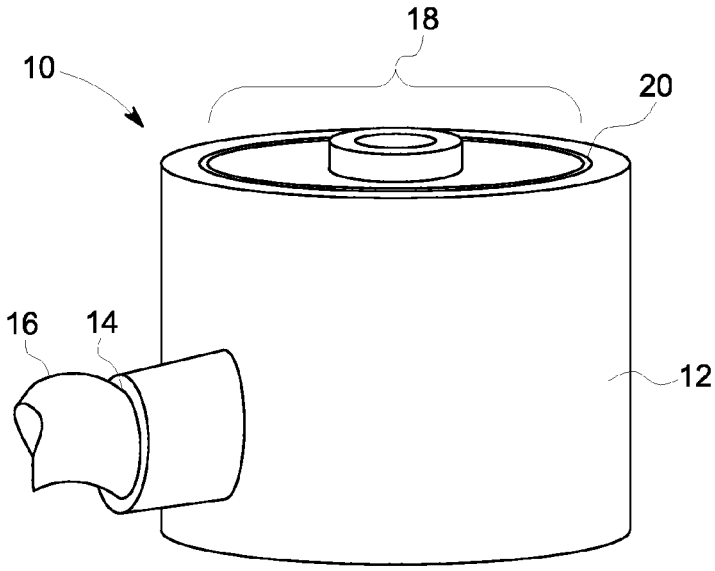
FIG. 1 is a perspective view of an X-ray shielded connector, in accordance with an embodiment of the invention.

Turning now to the figures, FIG. 1 is a view of an X-ray shielded connector 10. X-ray shielded connector 10 includes a housing 12 designed to protect and support the internal components of the X-ray shielded connector 10. The housing 12 may include a generally closed body with openings at two ends. The housing 12 may further cover one of the open ends. Additionally, X-ray shielded connector 10 may include a cable opening 14 configured to accept an electrical cable 16. Further, X-ray shielded connector 10 may include a connector opening 18, configured to make an electrical connection to the X-ray system. For example, the X-ray shielded connector 10 may connect to a cathode assembly, capable of producing an electron stream when provided with high voltage power. As will be discussed in more detail below, the X-ray shielded connector 10 may include an X-ray shielded liner 20 doped with X-ray attenuating material, contained within the housing 12. As off-focal X-rays reach the X-ray shielded liner 20, the X-rays will be attenuated, thus preventing the X-rays from passing through the X-ray shielded connector 10.

Figure 2:
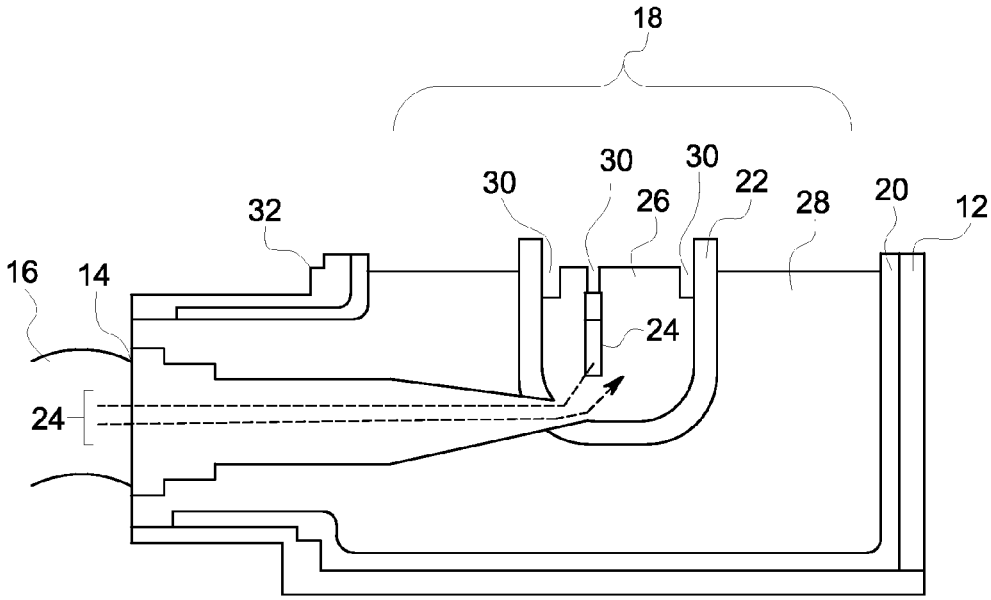
FIG. 2 is a cross-sectional side view of an X-ray shielded connector.

The advantages of the present embodiments may be more clearly appreciated with reference to FIG. 2, which is a cross-sectional side view of an X-ray shielded connector 10. The X-ray shielded connector 10 may include an X-ray shielding liner 20 disposed in the housing 12. The X-ray shielding liner 20 may include an opening for the passage of an electrical cable 16 through the cable opening 14. Additionally, the X-ray shielding liner 20 may include a connector opening 18 allowing the passage of an electrical connection.

To simplify manufacturability, the X-ray shielding liner 20 may be incorporated into the housing 12 by disposing (i.e., gluing or pouring) moldable synthetic material doped with an X-ray attenuating material into the housing 12. For example, the X-ray shielding liner 20 may include a thermoplastic or epoxy doped with X-ray attenuating materials, poured or glued into the housing 12. Alternatively, the doped moldable material may be molded such that it is used as the structural housing 12 for the X-ray shielded connector 10. Examples of X-ray attenuating materials may include tungsten, tantalum, bismuth, and/or lead. By pouring or gluing X-ray shielding materials into a housing 12, manufacturing complexity may be reduced because welding and/or brazing of separate shielding components may not be required. Furthermore, pouring or gluing of the shielding material may result in a seamless shield, thus reducing pathways for off-focal X-ray radiation to escape. The molded, doped, assembly will also provide a non-toxic alternative to current options at a lighter weight. The formed X-ray shielding liner 20 may include an upstanding side wall and a rear wall defining a continuous single-piece structure. The X-ray shielding liner 20 may provide shielding from X-rays emitted by the X-ray system. As X-rays from the X-ray system come in contact with the X-ray shielded connector 10, the X-ray attenuating materials within the X-ray shielding liner 20 will cause the X-rays to reduce in intensity, thus shielding external components from the off-focal X-rays.

In addition, the X-ray shielded connector 10 may include an inner cup 22 where electrical connections may be made with the electrical cable 16. Electrical cable 16 may extend through the cable opening 14, the opening in the X-ray shielding liner 20, and the cup 22. Conductors 24 in the cup may be joined with conductors in cable (i.e., through soldering), creating an electrical connection. The X-ray shielded connector 10 may further include potting materials 26 disposed inside the cup 22, encompassing the electrical connection within the cup. Additional potting materials 28 may be disposed in the X-ray shielding liner 20, surrounding the cup 22.

Recesses 30 may be incorporated into the potting material 26 inside the cup 22. The recesses may allow an electrical connection between the conductors 24 and the X-ray system. Furthermore, the recesses 30 may provide guidance paths for the electrical connection within the cup 22.

Additionally, the high voltage connector may include a bolted strain relief system 32. The bolted strain relief system 32 may be designed to allow the high voltage electrical cable 16 to be bolted to the housing 12, reducing strain on the X-ray shielded connector 10 at the cable opening 14.

Figure 3:
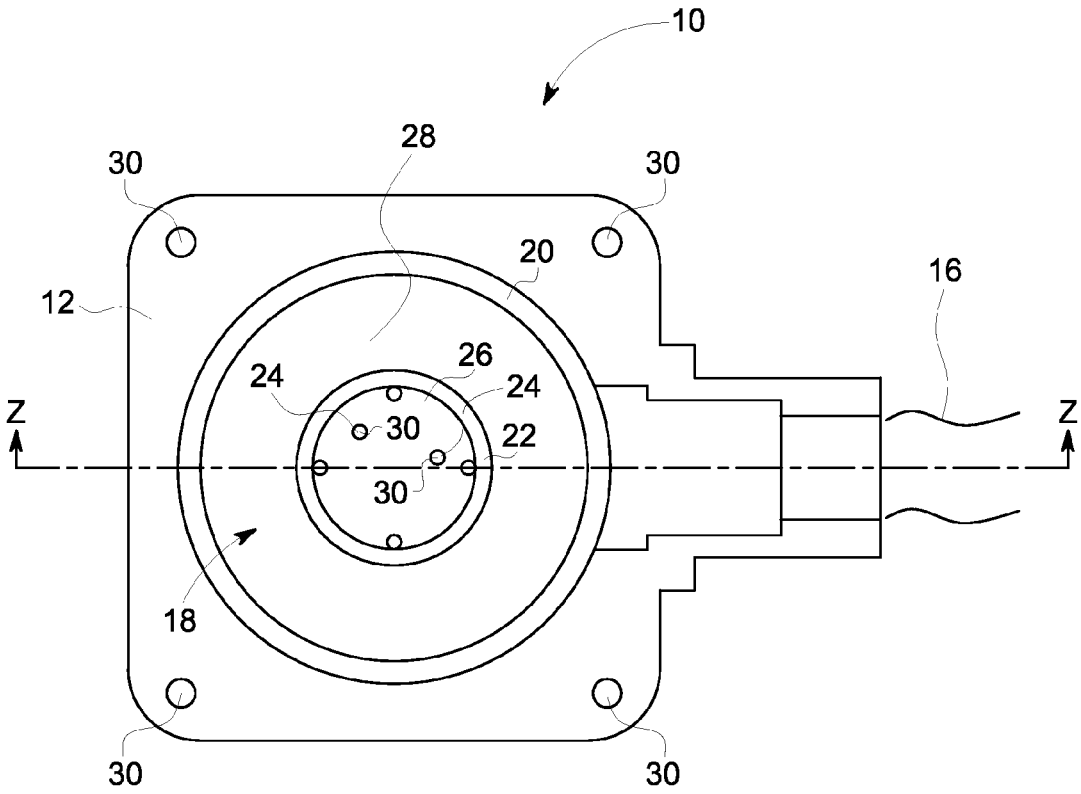
FIG. 3 is top-view of the embodiment of an X-ray shielded connector depicted in FIG. 2.

FIG. 3 is a top view of the X-ray shielded connector 10 of FIG. 2. As previously discussed, the X-ray shielded connector 10 may include a housing 12, configured with cable opening 14, designed to allow the passage of an electrical cable 16. The housing 12 may also include an electrical connector opening 18, configured to allow an electrical connection. An X-ray shielding liner 20, made of a moldable synthetic material doped with X-ray attenuating material, may be disposed (i.e., by gluing or pouring) in the housing 12. Additionally, cup 22 may be disposed inside the housing. Conductors 24, inside the cup 22, may be coupled to the electrical cable 16, which extends into the cup 22. The cup may contain potting materials 26, surrounding the coupled conductors 24. Some recesses 30 within the potting materials 26 may provide access to conductors 24, while other recesses 30 within the potting materials 26 may provide guidance for components making a connection to the X-ray shielded connector 10. The cup 22 may be secured in the X-ray shielded connector 10 through potting materials 28 disposed between the cup 22 and the X-ray shielding liner 20. Additionally, recesses 30 within the housing 12 may be provided as attachment holes useful for attaching the X-ray shielded connector 10 to a component making an electrical connection with the X-ray shielded connector 10 (i.e., a cathode assembly).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A connector comprising:

a housing having a cable opening for an electrical cable and a connector opening for an electrical connection;

an electrical cable extending through the cable opening;

a cup disposed in the housing, the electrical cable extending into the cup;

at least one conductor electrically coupled to the electrical cable in the cup;

an X-ray shielding liner disposed in the housing and having openings for passage of the electrical cable and for the electrical connection, the liner comprising a moldable synthetic material doped with an X-ray attenuating material;

a first potting material disposed in the cup, wherein at least one or a plurality of recesses are disposed within the first potting material and configured to receive the electrical connection and at least one conductor; and a second potting material surrounding the cup except at the connector opening.

2. The connector of claim 1, wherein the liner comprises an upstanding side wall and a rear wall defining a continuous single-piece structure.

3. The connector of claim 1, wherein the housing comprises a generally closed body open at two ends, and a cover disposed over one of the open ends and over the liner.

4. The connector of claim 1, wherein the liner comprises a thermoplastic doped with the X-ray attenuating material.

5. The connector of claim 1, wherein the liner comprises an epoxy doped with the X-ray attenuating material.

6. The connector of claim 1, wherein the X-ray attenuating material comprises at least one of tungsten, tantalum, bismuth, and lead.

* * * * *